United States Patent [19]

Leroux

[11] 4,073,177

[45] Feb. 14, 1978

[54] METHOD FOR BENDING THICK PROFILED PARTS, PART OBTAINED THEREBY AND APPLICATION THEREOF TO PANE FRAMINGS AND THE LIKE

[75] Inventor: Serge André Leroux, Vaux-sur-Seine, France

[73] Assignee: Etablissements Leroux S.A., Meulan, France

[21] Appl. No.: 675,330

[22] Filed: Apr. 9, 1976

[30] Foreign Application Priority Data

May 12, 1975 France ..... 75 14718

[51] Int. Cl.[2] ..... B21D 11/00

[52] U.S. Cl. ..... 72/339; 113/116 HA; 52/631; 52/658; 228/142

[58] Field of Search .... 113/116 A, 116 HA, 116 HH; 29/150, 155 R; 228/142; 52/631, 658; 72/339; 83/917; 160/381

[56] References Cited

U.S. PATENT DOCUMENTS

| | | | |
|---|---|---|---|
| 2,185,904 | 1/1940 | Stowe | 113/116 HA |
| 2,462,199 | 2/1949 | Kehoe et al. | 29/155 R |
| 2,831,244 | 4/1958 | Adell | 113/116 HA |
| 3,911,554 | 10/1975 | Ford | 228/142 |

*Primary Examiner*—Lowell A. Larson

[57] ABSTRACT

In each arm of a profiled part a notch is made. The notch has two convergent edges forming an angle substantially equal to the angle to be made with the profiled parts. The notch is designed of such a size that the bending can be easily made by applying a compression stress combined with a folding stress in order to reduce at a minimum the extension of lengthening during the folding without reaching the breaking limit of the material constituting the profiled part.

11 Claims, 7 Drawing Figures

METHOD FOR BENDING THICK PROFILED PARTS, PART OBTAINED THEREBY AND APPLICATION THEREOF TO PANE FRAMINGS AND THE LIKE

The present invention relates to the bending of thick profiled parts, such as parts having in cross section the shape of a U, a V or a W or even more complex shapes, typically profiled parts which, on one side, exhibit the general shape of a U and which, on the other side, form a channel between the web or bottom portion connecting the two arms of the U and an upright edge. Such profiled parts are sometimes manufactured by extrusion or still by rolling. In that latter case they are continuously formed from a metal strip which is progressively folded by successive sets of rollers.

Profiled parts of such a type are usually used, typically to realize framings for door and window panes. This is particularly the case in the motor-car industry where it is very often necessary to design door-pane framings, said framings having to contain insulating fittings for the so-called pane and also to support an insulating flange pinched between the framing and the body of the vehicle when the door is closed.

It is very frequent, particularly in the last mentioned example of application, that for aesthetic or safety matters, the profiled part be bent according to very small curve radii and in such a way that two successive segments of parts form an angle together. Up to now, to obtain these results, it was necessary to saw cut portions of the profiled parts, then to connect the portions through welding, typically arc welding or flash welding.

This method of processing is very long and, consequently, very costly. Actually, in a complex profiled part having two grooves opposite to a core, one for containing the suitable pane fittings and the other for containing the insulating or watertight flange, welding must be performed in the bottom of the grooves, thus to locations which are difficult of access. Then, to position the insulating fittings and flange, and also for the framing to show a high finish, it is necessary to plane and to polish the weld beads for them to be no longer visible. This work is still made complicated since the wings edging the grooves are not, in general, plane, but are, on the contrary, most of the time provided with ribs and also various sides.

The present invention creates a new method of bending which permits to reduce the welding operation only to perfectly accessible portions of the profiled parts after they have been bent and on portions of said profiled parts which are easy to polish or even not necessary to polish, whereby the time of manufacturing the parts are considerably reduced.

According to the invention, there is provided a method for angle bending a profiled part of a longitudinal extension and having at least one arm and a main web parallel to the longitudinal extension of the profiled part, comprising the steps of forming in said arm a notch extending on a portion its width and substantially to said main web, said notch delimiting two segments of profiled part and having two edges making an angle substantially equal to the angle the profiled part has to be bent, and said two edges of the notch leading towards a bottom portion having a width depending on the bending angle and on the non-notched or plain thickness of the material of the profiled part, exerting then on the two segments of profiled part on each side of said notch, a compression stress combined with a folding force so that the material of said bottom portion of the notch tends to retract and to flow towards side of the profiled part opposite the notch during the folding to form an outer round, whereby the material of the profiled part forming the outer round is only submitted to a reduced extension or lengthening preventing said material to be submitted to stresses reaching the breaking limit.

Various other features of the invention are moreover revealed from the following detailed description.

An embodiment of the invention is shown by way of non-restrictive example in the accompanying drawings, in which.

Figure 1:
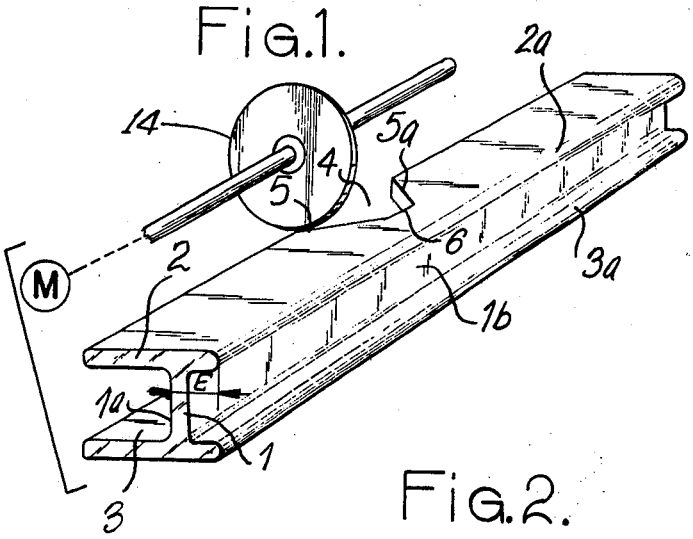
FIG. 1 is a perspective view of a portion of profiled part prepared to be bent according to the invention.

The profiled part illustrated in FIG. 1 has in cross section substantially the shape of a "U", i.e. it comprises a bottom portion or main web 1 and two lateral arms 2 and 3. Besides, flanges 2*a*, 3*a* protrude from the main web 1 and extend in the continuation of the arms 2, 3.

According to the invention, to fold said profiled part according to any angle which can be a very sharp angle, there is first provided in the arms 2, 3 a notch 4 through cutting, milling, crunching or like other mechanical means 14, the lateral edges 5, 5*a* of said notch making together an angle substantially equal to the angle the profiled part has to be folded. The edges 5, 5*a* of the notch 4 lead to a plane section 6 delimiting the bottom of the notch 4, said plane section 6 being formed up to the level of the inner surface 1*a* of the main web 1 or at immediate vicinity of said surface but without reaching the main web. The width L of the plane section 6 essentially depends on the size E of the main web 1 and of the outer flanges 2*a*, 3*a* and also on the angle to which must be folded the profiled part. The larger is E, the larger must be the width L.

A next operation consists of maintaining the two segments A, B of the profiled part which are on each side of the notch 4 in claws shown at 7, 8 and moving said claws 7, 8 in such a way they exert a push along arrows $f_1$ as well as a bending force along arrows $f_2$. Thus during the bending, a high compression force is exerted at the level of the plane section 6 while the bending stress along the arrows $f_2$ tends to extend or stretch the metal at the surface 1*b* of main web 1.

Figure 2:
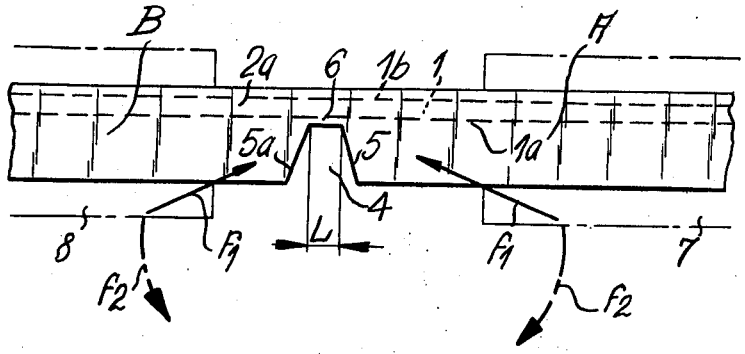
FIG. 2 is a top view illustrating a working step.
Figure 3:
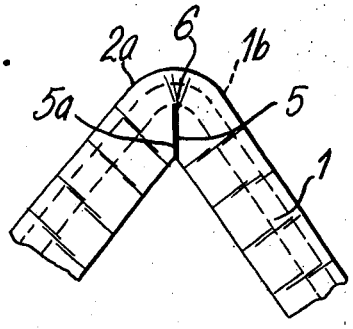
FIG. 3 is a top view showing the profiled part as folded.

The compression forces exerted along arrows $f_1$ must be high enough so that the metal of surface 1*a* will tend to flow towards the surface 1*b*. There is thus obtained that at the end of the bending operation that the two edges 5, 5*a* be brought one against each other as illustrated in FIG. 3, while the plane section 6 of FIGS. 1 and 2 is reduced to an arc of circle of a small diameter but eliminating any beginning of a break. Due to the flow of the metal produced by the forces exerted along the arrows $f_1$, there is obtained that the surface 1*b* of the web portion 1 be perfectly curved and that the flanges 2*a*, 3*a* be only a little crushed without exhibiting any crack because the lengthening to which they are submitted remains always below the metal breaking limit.

FIGS. 4–7 show the method of the invention when it is embodied for folding a profiled part having complex shape obtained by rolling a metal strip with a roller, this profiled part being, for example, of the type used for the realization of window framings for motor-cars.

Figure 4:
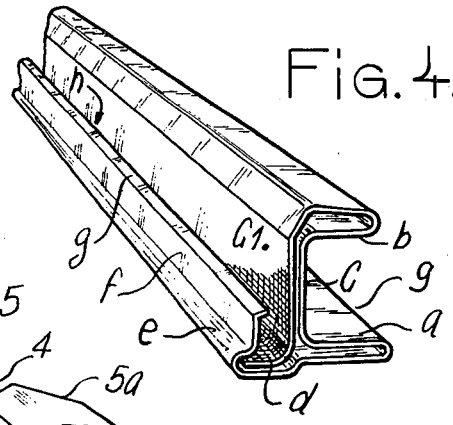
FIG. 4 is a perspective view of another type of profiled part.
Figure 5:
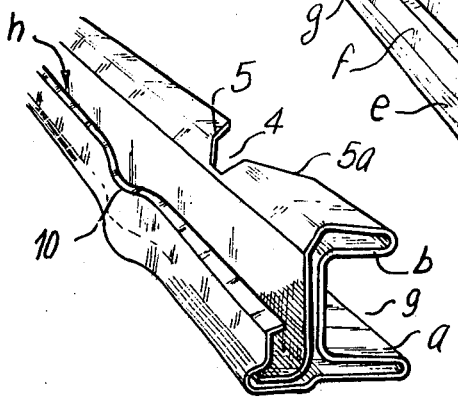
FIG. 5 is a perspective view of the profiled part of FIG. 4 illustrating characteristic manufacturing operations.
Figure 6:
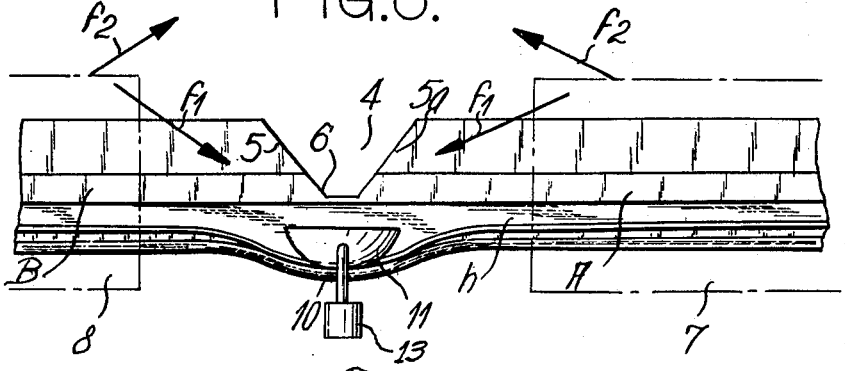
FIG. 6 is a top view corresponding to FIG. 5 and illustrating another manufacturing operation.

FIG. 4 shows a profiled part, which, briefly, is folded to delimit two double arms *a, b,* connected to a main web formed by two webs *c*, $c_1$, the web $c_1$ being extended by a base *d* whose end is housed in an outer flange *e* from which is formed an upright edge *f* terminated by a recessed rod *g* which delimits, with the web $c_1$ a passage *h*.

Profiled parts of the type shown in FIG. 4 are used for the realization of pane framings for motor-car doors. Actually, the groove 9 delimited between the arms *a, b,* is used for positioning joints to receive the edges of a pane and the channel *h* is used for placing a flexible flange, for example made of rubber, which is tightened by the recessed rod *g*, said flange being used to provide the tightness between the door and body of a vehicle.

Figure 7:
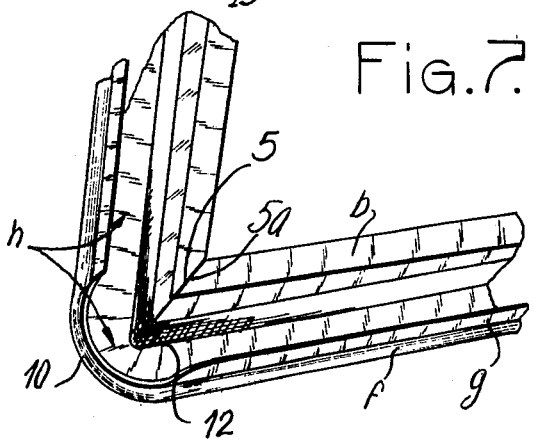
FIG. 7 is a top perspective view showing the profiled part after folding.

To form the profiled part in the manner shown in FIG. 7, the process is substantially the same as that already described with reference to FIGS. 1–3; a notch 4 is made in arms *a, b,* said notch 4 having a bottom portion or section 6 towards which converge the sides 5, 5*a* delimiting the notch. Besides, there is provided at the level of the notch 4, a raising of the rod *g* and a stretching of both said rod *g* and the upright edge *f* as shown at 10 in FIGS. 5 and 6. The stretching is made to form a round, for example by means of a pulling finger 11 controlled by a suitable jack 13.

As in the preceding example, the two portions A, B, formed on each side of the notch 4 and the round 10 are tightened in claws 7, 8, and a compression force is exerted along the arrows $f_1$ through said claws, at the same time as a bending stress along the arrows $f_2$. Then, the metal of the webs *c*, $c_1$ tend to be restricted at the fold beginning while the metal of the base *d* and of the underneath portion of the flange *e* tends to be slightly extended or lengthened. The pre-stretching at 10 of the upright edge *f* and of the rod *g* prevents this portion of the profiled part to work to the extension in an excessive manner during the bending process, properly so-called, which causes the passage *h* not to be submitted to any change of width at the finished folding 12 (FIG. 7).

Since the notch 4 is only formed in the arms, the folding 12 of the webs is perfectly neat and it suffices, after the folding, to make a slight addition of material into the narrow slot which remains between the sides 5, 5*a*, for example through flash welding, to obtain a finished product of a very fine sight.

The invention is not restricted to the embodiments shown and described in detail, for various modifications thereof can moreover be applied thereto without departing from the scope of the present invention, as shown in the appended claims.

I claim:

1. Method for angle bending a profiled part of a longitudinal extension and having at least one arm and a main web parallel to the longitudinal extension of the profiled part, comprising the steps of forming in said arm a notch extending on a portion of its width and substantially to said main web, said notch delimiting two segments of profiled part and having two edges making an angle substantially equal to the angle the profiled part has to be bent, and said two edges of the notch leading towards a bottom portion having a width depending on the bending angle and on the non-notched or plain thickness of the material of the profiled part, subsequently applying on the two segments of profiled part on each side of said notch a compression stress combined with a folding force, so that the material of said bottom portion of the notch tends to retract and to flow towards a side of the profiled part opposite the notch during the folding to form an outer round, whereby the material of the profiled part forming the outer round is only submitted to a limited lengthening preventing said material from being submitted to stresses reaching the breaking limit.

2. Method as set forth in claim 1, wherein the profiled part has a cross section of a substantially U-shape, the method further comprising the step of making two identical and superposed notches, one in each arm of the U, said notches extending approximately down to the main web of the profiled part.

3. Method as set forth in claim 1, wherein the profiled part has at least one arm extending on one side of the main web of the profiled part and a shoulder and an upright edge extending on the other side of said arm relative to the main web, the method further comprising the step of making, in said upright edge, a deformation through stretching to move said upright edge away from said main web in shaping it in a rounded manner, said deformation being aligned with the notch made in the arm on the other side of the web, and wherein the compression and bending is made while maintaining the portion as pre-stretched in such a way that the material rotates around said portion without being again stretched during the bending process.

4. Method as set forth in claim 1, comprising welding the edges of the notch when said edges are brought in coincidence after the bending operation.

5. The method of claim 1, further including the steps of further bending said part to form a pane framing, typically for doors and the like.

6. Device for angle bending a profiled part of a longitudinal extension and having at least one arm and a main web extending parallel to the longitudinal extension of the profiled part, comprising means for forming in said arm a notch extending on a portion of its width and substantially, to said main web, said notch delimiting two segments of profiled part and having two edges making an angle substantially equal to the angle the profiled part has to be bent, and said two edges of the notch leading towards a bottom portion of a width depending on the bending angle and on the non-notched or plain thickness of the material of the profiled part, means for exerting on the two segments of profiled part on each side of sid notch, a compression stress combined with a folding force, so that the material of said bottom portion of the notch tends to retract and to flow towards side of the profiled part opposite the notch during the folding to form an outer round, whereby during bending the material of the profiled part forming the outer round is only submitted to a limited lengthening preventing said material to be submitted to stresses reaching the breaking limit.

7. Device as set forth in claim 6, comprising, when the profiled part has a cross section of a substantially U-shape, means for making two identical and superposed notches, one in each arm of the U, said notches extending approximately down to the main web of the profiled part.

8. Device as set forth in claim 7, further comprising, when the profiled part has at least one arm extending on one side of the main web of the profiled part and a shoulder and an upright edge extending on the other side of said arm relative to said main web, means for making, in said upright edge, a deformation through stretching to move said main upright edge away from said web in shaping it in a rounded manner, said deformation being aligned with the notch made in the arm on the other side of the main web, means for maintaining the portion as pre-stretched during the compression and bending in such a way that the material rotates around said portion without being again stretched during the bending process.

9. Device as set forth in claim 7, comprising means for welding the edges of the notch when said edges are brought in coincidence.

10. A deep profiled part having at least a wide arm and a main web bent according to a small bending radius wherein:

the wide arm has been cut to form a notch of a trapezoidal shape prior to bending, the portion forming the main web has been folded while causing the material of the part partially to flow from the smallest bending radius to the largest bending radius by exerting on each side of said notch a compression stress combined with a folding force.

11. The profiled part of claim 10, wherein said part is adapted for use as pane framing typically for doors and the like.

* * * * *